US011568824B2

(12) United States Patent
Kim et al.

(10) Patent No.: US 11,568,824 B2
(45) Date of Patent: Jan. 31, 2023

(54) ELECTROLUMINESCENCE DISPLAY DEVICE

(71) Applicant: LG DISPLAY CO., LTD., Seoul (KR)

(72) Inventors: Daekyu Kim, Paju-si (KR); Kyuhan Yoon, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/500,265

(22) Filed: Oct. 13, 2021

(65) Prior Publication Data

US 2022/0172681 A1 Jun. 2, 2022

(30) Foreign Application Priority Data

Nov. 30, 2020 (KR) ..... 10-2020-0164145

(51) Int. Cl.
*G09G 3/3266* (2016.01)

(52) U.S. Cl.
CPC ... *G09G 3/3266* (2013.01); *G09G 2300/0426* (2013.01); *G09G 2300/0842* (2013.01); *G09G 2330/028* (2013.01)

(58) Field of Classification Search
None
See application file for complete search history.

(56) References Cited

U.S. PATENT DOCUMENTS

2019/0164491 A1* 5/2019 Kim ..... G09G 3/3233
2020/0402457 A1* 12/2020 Ueno ..... G09G 3/3266
2021/0049959 A1* 2/2021 Park ..... G09G 3/325
2021/0312861 A1* 10/2021 Wang ..... G09G 3/3233
2022/0148517 A1* 5/2022 Kim ..... G09G 3/3291

FOREIGN PATENT DOCUMENTS

KR 2019-0076177 A 7/2019
KR 2020-0055580 A 5/2020

* cited by examiner

*Primary Examiner* — Nitin Patel
*Assistant Examiner* — Amen W Bogale
(74) *Attorney, Agent, or Firm* — Polsinelli PC

(57) ABSTRACT

An electroluminescence display device comprises a light emitting diode having an anode connected to a node A, and a pixel driving circuit supplying a driving current to the node A and including a node B, a node C and a node D. The pixel driving circuit includes a driving transistor controlled by a voltage supplied to the node B, a first transistor turned on by a first scan signal, supplying a data voltage to the node C, a second transistor turned on by a second scan signal, electronically connecting the node B with the node C, a third transistor turned on by an emission signal, electronically connecting the node D with a node E, a fourth transistor turned on by a C signal, supplying a reference voltage to the node E, a storage capacitor connected to the node B and the node D, and a capacitor connected to the node C and a reference voltage line to which the reference voltage is supplied. In this case, the emission signal includes a pulse overlapping with the first scan signal and the second scan signal, and the C signal includes a pulse overlapping with the emission signal without overlapping with the first scan signal and the second scan signal.

13 Claims, 4 Drawing Sheets

ELECTROLUMINESCENCE DISPLAY DEVICE

CROSS-REFERENCE TO RELATED APPLICATION

This application claims the benefit of the Korean Patent Application No. 10-2020-0164145 filed on Nov. 30, 2020, which is hereby incorporated by reference in its entirety as if fully set forth herein.

BACKGROUND

Field of the Disclosure

The present disclosure relates to an electroluminescence display device that can improve picture quality of a display panel.

Description of the Background

With the advancement of the information technology, the market for a display device which is a connection medium between a user and information has been increased. Therefore, use of various types of display devices such as an electroluminescence display device, a liquid crystal display (LCD) device, an organic light emitting display (OLED) device and a quantum dot light emitting display (QLED) device has been increased.

Among the display devices, the electroluminescence display device has advantages in that a response speed is fast, light emission efficiency is high and a viewing angle is wide. Generally, the electroluminescence display device applies a data voltage to a gate electrode of a driving transistor by using a transistor turned on by a scan signal and charges the data voltage supplied to the driving transistor in a storage capacitor. The electroluminescence display device allows a light emitting diode to emit light by outputting the data voltage charged in the storage capacitor using an emission signal. The light emitting diode may include one of an organic light emitting diode, an inorganic light emitting diode, and a quantum dot light emitting diode.

A display panel which is a minimum device for displaying an image may be categorized into a display area provided with a pixel array, for displaying an image, and a non-display area for not displaying an image. The pixel array includes a plurality of pixels, each of which includes a light emitting diode and a pixel driving circuit. The light emitting diode emits light by a driving current supplied by the pixel drive circuit.

Therefore, a method for improving a driving capacity to allow light emitting diodes to emit light in an intended gray scale has been developed.

As described above, the electroluminescence display device includes a pixel array, and each pixel constituting the pixel array includes a light emitting diode and a pixel driving circuit supplying a driving current to the light emitting diode. The pixel driving circuit may be embodied with various forms to supply an exact driving current to the light emitting diode.

The pixel array may include pixels emitting lights of red, green, blue, etc. The driving current supplied to the light emitting diode by the pixel driving current is generated in a different way which depends on color property and gray scale of light which is emitted. For example, when the pixel array includes a red pixel, a green pixel, and a blue pixel, a different driving current is needed for each of the red pixel, the green pixel, and the blue pixel even though the same gray scale is displayed. Generally, the smallest driving current is needed for the red pixel and the biggest driving current is needed for the blue pixel. A driving current needed for the green pixel is a value between the driving current needed for the red pixel and the driving current needed for the blue pixel.

In this way, a different value of the driving current is needed depending on the type of pixels even in the same gray scale and also a different value of the driving current is needed for the same type of pixels depending on the different gray scale. Particularly, when a lower value of a gray scale is displayed, delay may occur in the anode charging time of the light emitting diode, and a defect may occur in picture quality of the display panel. Since the anode charging of the light emitting diode depends on a driving capacity of the pixel driving circuit, a structure and a driving method of the pixel driving circuit may be changed to avoid an anode charging delay of the light emitting diode.

SUMMARY

Accordingly, the present disclosure has been made in view of the above problems, and the present disclosure provides an electroluminescence display device that may prevent an anode charging delay of a light emitting diode from occurring.

In addition, the present disclosure will be clearly understood by those skilled in the art from the following description of the present disclosure.

The features of the present disclosure can be accomplished by the provision of an electroluminescence display device comprising a light emitting diode having an anode connected to a node A, and a pixel driving circuit supplying a driving current to the node A and including a node B, a node C and a node D. The pixel driving circuit includes a driving transistor controlled by a voltage supplied to the node B, a first transistor turned on by a first scan signal, supplying a data voltage to the node C, a second transistor turned on by a second scan signal, electronically connecting the node B with the node C, a third transistor turned on by an emission signal, electronically connecting the node D with a node E, a fourth transistor turned on by a C signal, supplying a reference voltage to the node E, a storage capacitor connected to the node B and the node D, and a capacitor connected to the node C and a reference voltage line to which the reference voltage is supplied. In this case, the emission signal includes a pulse overlapping with the first scan signal and the second scan signal, and the C signal includes a pulse overlapping with the emission signal without overlapping with the first scan signal and the second scan signal. Therefore, delay in charging the anode of the light emitting diode may be prevented from occurring, and a defect in picture quality of a display panel in case of a low gray scale may be prevented from occurring.

In accordance with an aspect of the present disclosure, the features of the present disclosure can be accomplished by the provision of an electroluminescence display device comprising a light emitting diode having an anode connected to a node A, and a pixel driving circuit supplying a driving current to the node A and including a node B, a node C and a node D. The pixel driving circuit is embodied to be driven in accordance with an initialization period, a sampling period, a holding period, a first emission period, and a second emission period, and includes a driving transistor controlled by the node B and turned on during the first emission period and the second emission period, a first transistor turned on during the sampling period, supplying a data voltage to the node D, a second transistor turned on during the initialization period and the sampling period, electronically connecting the node B with the node C, a transistor group controlled by at least two signals to allow the node D to be maintained at an electrically floated state during the first emission period, a storage capacitor connected to the node B and the node D, and a capacitor connected to the node D and a gate node of the transistor group. In this case, a voltage of the node B is embodied to be more dropped during the first emission period than a voltage of the holding period. Therefore, delay in charging the anode of the light emitting diode may be prevented from occurring, and a defect in picture quality of a display panel in case of a low gray scale may be prevented from occurring.

Details of the other aspects are included in the detailed description and drawings.

According to the aspects of the present disclosure, the pixel driving circuit is embodied to include a driving transistor, a storage capacitor of which one electrode is connected to a gate node of the driving transistor and the other electrode is connected to the node D, a transistor group connected between the node D and the reference voltage line, and a capacitor connected between the node D and a signal line controlling the transistor group, whereby delay in charging the anode of the light emitting diode may be prevented from occurring, and thus a defect in picture quality of a display panel in case of a low gray scale may be prevented from occurring.

According to the aspects of the present disclosure, the emission period in the pixel driving circuit driven in accordance with the initialization period, the sampling period, the holding period, and the emission period is divided into the first emission period and the second emission period, and the voltage of the gate electrode of the driving transistor is dropped by the coupling effect of the capacitor and the storage capacitor to turn on the driving transistor during the first emission period, whereby the anode voltage of the light emitting diode may quickly be charged.

In addition to the effects of the present disclosure as mentioned above, additional features of the present disclosure will be clearly understood by those skilled in the art from the following description of the present disclosure.

BRIEF DESCRIPTION OF THE DRAWINGS

The other features and advantages of the present disclosure will be more clearly understood from the following detailed description taken in conjunction with the accompanying drawings, in which.

DETAILED DESCRIPTION

Figure 1:
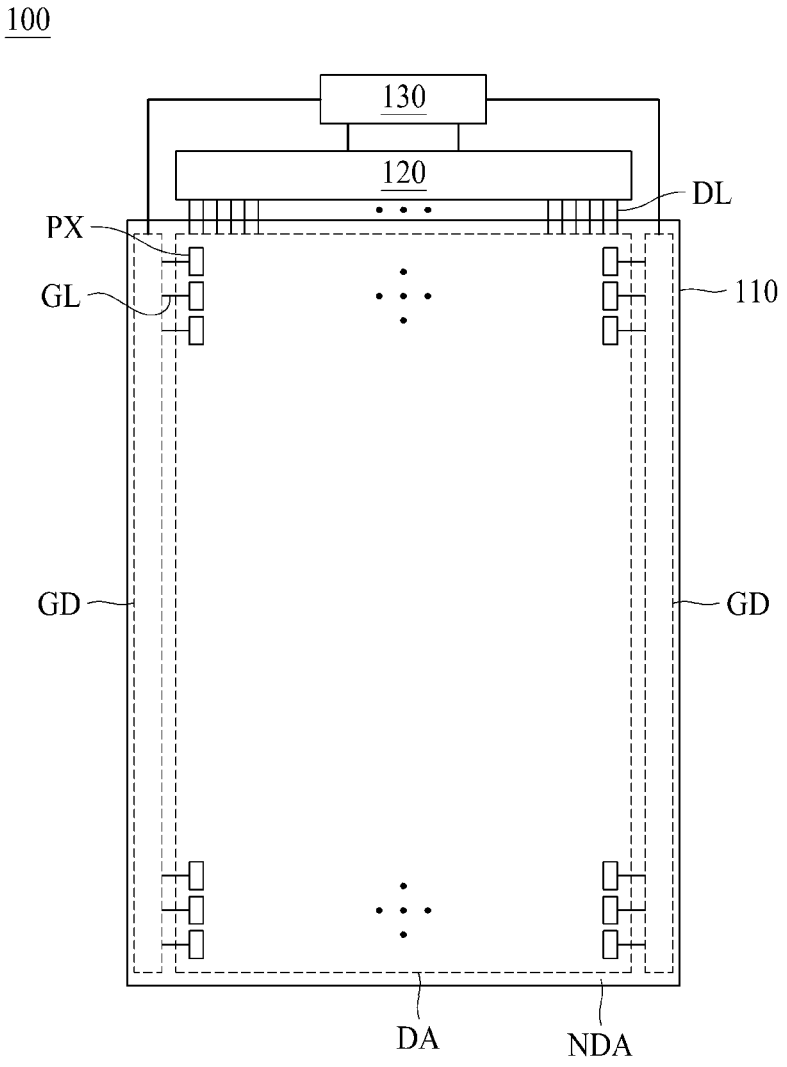
FIG. 1 is a block view illustrating an electroluminescence display device according to one aspect of the present disclosure.

Advantages and features of the present disclosure, and implementation methods thereof will be clarified through following aspects described with reference to the accompanying drawings. The present disclosure may, however, be embodied in different forms and should not be construed as limited to the aspects set forth herein. Rather, these aspects are provided so that this disclosure will be thorough and complete, and will fully convey the scope of the present disclosure to those skilled in the art. Further, the present disclosure is only defined by scopes of claims.

A shape, a size, a ratio, an angle, and a number disclosed in the drawings for describing aspects of the present disclosure are merely an example, and thus, the present disclosure is not limited to the illustrated details. Like reference numerals refer to like elements throughout the specification. In the following description, when the detailed description of the relevant known function or configuration is determined to unnecessarily obscure the important point of the present disclosure, the detailed description will be omitted. In a case where 'comprise', 'have', and 'include' described in the present specification are used, another part may be added unless 'only~' is used. The terms of a singular form may include plural forms unless referred to the contrary.

In construing an element, the element is construed as including an error range although there is no explicit description.

In describing a position relationship, for example, when the position relationship is described as 'upon~', 'above~', 'below~' and 'next to~', one or more portions may be arranged between two other portions unless 'just' or 'direct' is used.

In describing a time relationship, for example, when the temporal order is described as 'after~', 'subsequent~', 'next~', and 'before~', a case which is not continuous may be included unless 'just' or 'direct' is used.

Features of various aspects of the present disclosure may be partially or overall coupled to or combined with each other, and may be variously inter-operated with each other and driven technically as those skilled in the art can sufficiently understand. The aspects of the present disclosure may be carried out independently from each other, or may be carried out together in co-dependent relationship.

In the present disclosure, a pixel driving circuit formed on a substrate of a display panel may be embodied with an n-type or p-type transistor. For example, the transistor may be embodied with a transistor having a metal oxide semiconductor field effect transistor (MOSFET) structure. The transistor may be a three-electrode device including a gate electrode, a source electrode, and a drain electrode. The source electrode and the drain electrode of the transistor may not be fixed but be changed in accordance with a voltage applied thereto.

Hereinafter, a gate-on voltage may be a voltage of a gate signal capable of turning on a transistor and a gate-off voltage may be a voltage capable of turning off the transistor.

Hereinafter, a pixel driving circuit and an electroluminescence display device using the same according to one aspect of the present disclosure will be described with reference to the accompanying drawings.

FIG. 1 is a block view illustrating an electroluminescence display device 100 according to one aspect of the present disclosure.

Referring to FIG. 1, the electroluminescence display device 100 may include a display panel 110 on which a plurality of data lines DL and a plurality of gate lines GL are disposed and a plurality of pixels PX connected with the plurality of data lines DL and the plurality of gate lines GL are arranged, and driving circuits supplying driving signals to the display panel 110.

Although it is shown that the plurality of pixels PX are disposed in a matrix arrangement to a pixel array, without limitation to this example, the plurality of pixels may be disposed in various forms.

The driving circuit may include a data driving circuit 120 for supplying data signals to the plurality of data lines DL, a gate driving circuit GD for supplying gate signals to the plurality of gate lines GL, and a controller 130 for controlling the data driving circuit 120 and the gate driving circuit GD.

The display panel 110 may include a display area DA on which an image is displayed and a non-display area NDA which is at an outside area of the display area DA. In the display area DA, the plurality of pixels PX, the data lines DL supplying data signals to the plurality of pixels PX, and the gate lines GL supplying gate signals may be disposed.

The plurality of data lines DL disposed in the display area DA may be extended to the non-display area NDA and may thus electronically connected to the data driving circuit 120. The data lines DL electronically connect the plurality of pixels PX disposed in a column direction with the data driving circuit 120, and may be embodied in a single line or may be embodied by connecting a plurality of lines with one another through a contact hole by using a link line.

The plurality of gate lines GL disposed in the display area DA may be extended to the non-display area NDA and may be thus electronically connected to the gate driving circuit GD. The gate line GL electronically connects the plurality of pixels PX disposed in a row direction with the gate driving circuit GD. Additionally, gate driving related lines needed for the gate driving circuit GD to generate various gate signals and to drive the plurality of pixels PX may be disposed in the non-display area NDA. For example, the gate driving related lines may include one or more high-level gate voltage lines supplying a high-level gate voltage to the gate driving circuit GD, one or more low-level gate voltage lines for supplying a low-level gate voltage to the gate driving circuit GD, a plurality of clock lines for supplying a plurality of clock signals to the gate driving circuit GD, and one or more start lines for supplying one or more start signals to the gate driving circuit GD.

In the display panel 110, the plurality of data lines DL and the plurality of gate lines GL are disposed together with the pixel array. As described above, the plurality of data lines DL and the plurality of gate lines GL may respectively be disposed in a row or column. For convenience of description, it is assumed that the plurality of data lines DL are disposed in columns and the plurality of gate lines are disposed in rows, but the present disclosure is not limited thereto.

The controller 130 starts to scan a data signal in accordance with a timing embodied in each frame, converts externally input image data to be suitable for a data signal format used by the data driving circuit 120, outputs the converted image data, and control the data driving circuit 120 at a good time in accordance with the scan.

The controller 130 receives timing signals including a vertical synchronization signal, a horizontal synchronization signal, an input data enable signal, and a clock signal from the outside together with the input image data. The controller 130 that has received the timing signals generates and outputs control signals for controlling the data driving circuit 120 and the gate driving circuit GD.

For example, the controller 130 outputs various types of data control signals including a source start pulse, a source sampling clock, and a source output enable signal, to control the data driving circuit 120. The source start pulse controls a data sampling start timing of one or more data signal generating circuits constituting the data driving circuit 120. The source sampling clock is a clock signal controlling a sampling timing of data in each of the data signal generating circuits. The source output enable signal controls an output timing of the data driving circuit 120.

Also, the controller 130 outputs gate control signals including a gate start pulse, a gate shift clock, and a gate output enable signal, to control the gate driving circuit GD. The gate start pulse controls an action start timing of one or more gate signal generating circuits constituting the gate driving circuit GD. The gate shift clock is a clock signal commonly input to one or more gate signal generating circuits and controls a shift timing of a scan signal. The gate output enable signal designates timing information of one or more gate signal generating circuits.

The controller 130 may be a timing controller used in a typical art of a display device, or may be a control device capable of further performing other control function by including the timing controller.

The controller 130 may be embodied as a separate component from the data driving circuit 120, and may be embodied as a single integrated circuit by being combined with the data driving circuit 120.

The data driving circuit 120 may be embodied by including one or more data signal generating circuits. The data signal generating circuits may include a shift register, a latch circuit, a digital-to-analogue converter, and a output buffer. The data signal generating circuits may further include an analogue-to-digital converter in some cases.

The data signal generating circuits may be connected to a bonding pad of the display panel 110 by a tape automated bonding (TAB) method, a chip on glass (COP) method, or a chip on panel (COP) method, may directly be disposed on the display panel 110, or may be disposed by being integrated in the display panel 110. Also, the plurality of data signal generating circuits may be embodied by a chip on film (COF) method packaged on a source-circuit film connected to the display panel 110.

The gate driving circuit GD drives the plurality of pixels PX connected to the plurality of gate lines GL by sequentially supplying gate signals to the plurality of gate lines GL. The gate driving circuit GD may include a shift register and a level shifter.

The gate driving circuit GD may be connected to the bonding pad of the display panel 110 by a tape automated bonding (TAB) method, a chip on glass (COP) method, or a chip on panel (COP) method, or may be embodied in a GIP type and then may be disposed by being integrated in the display panel 110. Also, the plurality of gate signal generating circuits may be embodied by a chip on film (COF) method packaged on a gate-circuit film connected to the display panel 110. Hereinafter, for convenience of description, the case that the gate driving circuit GD includes a plurality of gate signal generating circuits, the plurality of gate signal generating circuits are embodied in a GIP type and thus disposed on the non-display area NDA of the display panel 110 will be described by way of example.

The gate driving circuit GD sequentially supplies gate signals of a transistor turn-on voltage (or gate-on voltage) or a transistor turn-off voltage (or gate-off voltage) to the plurality of gate lines GL under the control of the controller 30. Once a signal is supplied to a specific gate line by the gate driving circuit GD, the data driving circuit 120 converts image data received from the controller 130 into analog type data signals and then supplies them to the plurality of data lines DL.

The data driving circuit 120 may be positioned at one side of the display panel 110. For example, one side of the display panel 110 may be on top, bottom, left, or right side of the display panel 110. Also, the data driving circuit 120 may be positioned at both sides of the display panel 110 in accordance with a driving method, a panel design method, etc. For example, the data driving circuit 120 may be positioned at top and bottom sides or left and right sides of the display panel 110.

The gate driving circuit GD may be positioned at one side of the display panel 110. For example, one side of the display panel 110 may be on top, bottom, left, or right side of the display panel 110. Also, the gate driving circuit GD may be positioned at both sides of the display panel 110 in accordance with a driving method, a panel design method, etc. For example, the gate driving circuit GD may be positioned at top and bottom sides or left and right sides of the display panel 110.

Since the case that the plurality of gate lines GL disposed on the display panel 110 are disposed in a row direction and the plurality of date lines DL are disposed in a column direction is described by way of example, the description will be given on the assumption that the data driving circuit 120 is positioned at the top side of the display panel 110 and the gate driving circuit GD is positioned at the left and right sides of the display panel 110.

The plurality of gate lines GL disposed on the display panel 110 may include a plurality of scan lines and a plurality of emission lines. The plurality of scan lines and the plurality of emission lines are lines transferring different types of gate signals to gate electrodes of different types of transistors.

Therefore, the gate driving circuit GD may include a plurality of scan driving circuits outputting scan signals to a plurality of scan lines which correspond to one type of gate lines GL and a plurality of emission driving circuits outputting emission signals to a plurality of emission lines which correspond to another type of gate lines.

The electroluminescence display device 100 according to one aspect of the present disclosure may include a voltage generator. The voltage generator converts a voltage of power source, which is input to the electroluminescence display device 100 from the outside of the electroluminescence display device 100, into a power source suitable to drive the driving circuits included in the electroluminescence display device 100 or maintains the power source. The voltage generator is a semiconductor integrated element embodied separately from the gate driving circuit GD, the data driving circuit 120 and the timing controller 130, and may be embodied as one integrated circuit. The voltage generator increases an input voltage when the electroluminescence display device 100 is turned-on, and thus outputs a voltage needed for the timing controller 130 or the display panel 110.

Figure 2:
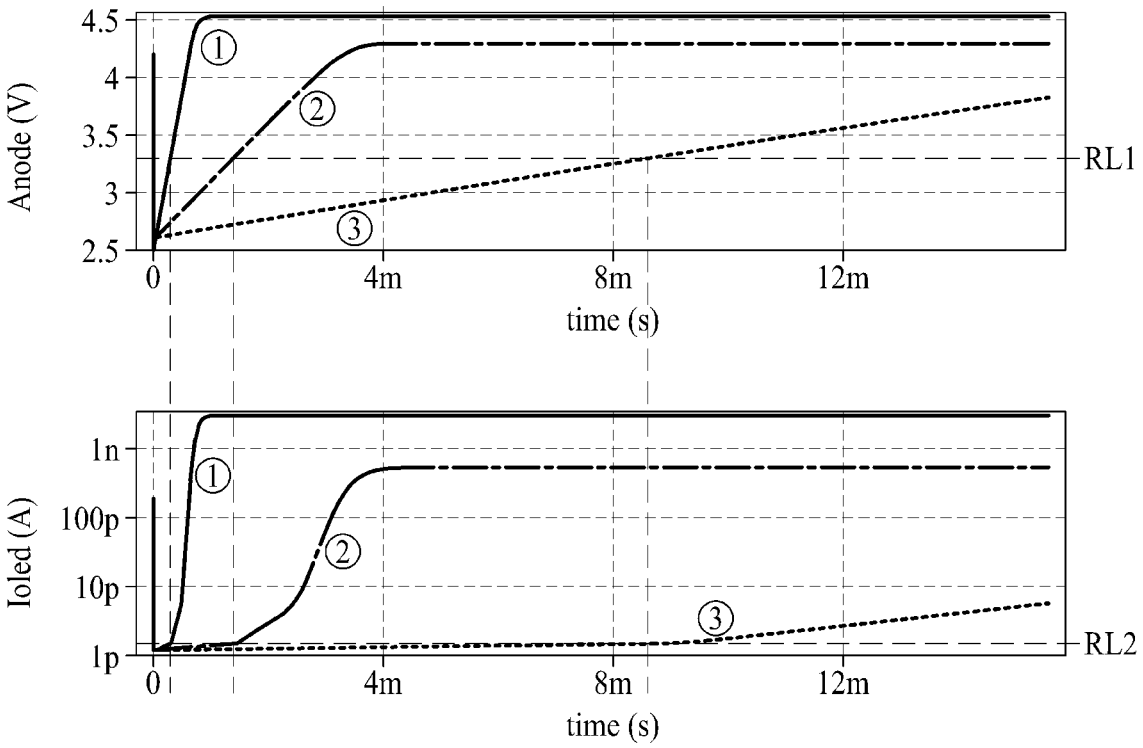
FIG. 2 is a graph illustrating an anode charging voltage and a driving current of a light emitting diode per gray scale in one pixel included in a display panel according to one aspect of the present disclosure.

FIG. 2 is a graph illustrating an anode charging voltage and a driving current of a light emitting diode per gray scale in one pixel included in a display panel according to one aspect of the present disclosure;

The display area DA includes a plurality of pixels PX and displays an image based on a gray scale displayed by each of the pixels PX. As described above, a pixel array may include the plurality of pixels PX emitting lights of red, green, blue, etc. The driving current supplied to the light emitting diode by the pixel driving current is different depending on a gray scale and a color of light which is emitted. For example, when the pixel array includes a red pixel, a green pixels, and a blue pixel, a different driving current is needed for each of the red pixel, the green pixel, and the blue pixel in a specific gray scale. Generally, the smallest driving current is needed for the red pixel and the biggest driving current is needed for the blue pixel. A driving current needed for the green pixel is a value between the driving current needed for the red pixel and the driving current needed for the blue pixel.

In this way, a different value of the driving current is needed depending on the type of pixels even in the same gray scale and also a different value of the driving current is needed for the same type of pixels depending on the different gray scale. Particularly, when a lower value of gray scale is displayed, delay may occur in the anode charging time of the light emitting diode, and a defect in picture quality of the display panel may be caused.

FIG. 2 illustrates an anode charging voltage and a driving current of a light emitting diode in accordance with a different level of gray scale using a green pixel by way of example. In the two graphs shown in FIG. 2, the graph on the upper side illustrates the anode charging voltage of the light emitting diode in accordance with a different level of gray scale of the green pixel and the graph on the lower side illustrates a driving current of the light emitting diode in accordance with a different level of gray scale of the green pixel.

In the upper graph, the Graph ① illustrates an anode charging voltage of the green pixel with 16Gray, the Graph ② illustrates an anode charging voltage of the green pixel with 8Gray, and the Graph ③ illustrates an anode charging voltage of the green pixel with 4Gray. Referring to the Graphs ①, ② and ③, the anode charging voltage tends to elevate in proportional to time to reach a certain time and converge on a certain voltage after a specific time passes. When a first reference line RL1 is arranged at about 3.3V before the anode voltage converges, the time required to elevate the voltage is the shortest in the Graph ①, followed by the Graph ②, and is the longest in the Graph ③. That is, as the gray scale to be displayed is lower, the time required to charge the anode voltage is increased. In detail, the time required to charge the anode voltage to reach 3.3V is about 0.3 ms at 16Gray, about 1.4 ms at 8Gray, and about 8.6 ms at 4Gray. It is noted that the time required to charge the anode voltage is remarkably increased as a gray scale gets lower.

In the lower graph, the Graph ① illustrates a driving current of the green pixel with 16Gray, the Graph ② illustrates a driving current of the green pixel with 8Gray, and the Graph ③ illustrates a driving current of the green pixel with 4Gray. Referring to the Graphs ①, ② and ③, the driving current tends to exponentially elevate to reach a certain time and converge on a certain current after a specific time passes. When the time required to charge the anode voltage at the upper graph is applied to the lower graph and a second reference line RL2 is arranged, the second reference line RL2 may be arranged at about 2 pA. In detail, the time required for the driving current to reach 2 pA is about 0.3 ms at 16Gray, about 1.4 ms at 8Gray, and about 8.6 ms at 4Gray. In the same manner as shown in the upper graph, it is noted that the time required to reach a specific driving current is remarkably increased as a gray scale gets lower.

In all of the Graphs ①, ② and ③ illustrated in FIG. 2 by way of example, a certain time is required to reach a target voltage and a target current. The low gray scale may be defined as a level lower than the gray scale at the time when delay occurs, and especially may be defined as a level lower than 16Gray, but is not limited thereto.

Also, the case that the anode charging time is delayed toward a lower gray scale means that a defect in picture quality of the display panel 110 is more likely to occur in a low gray scale. Therefore, a structure and a driving method of the pixel driving circuit to resolve this issue will be described below.

Figure 3:
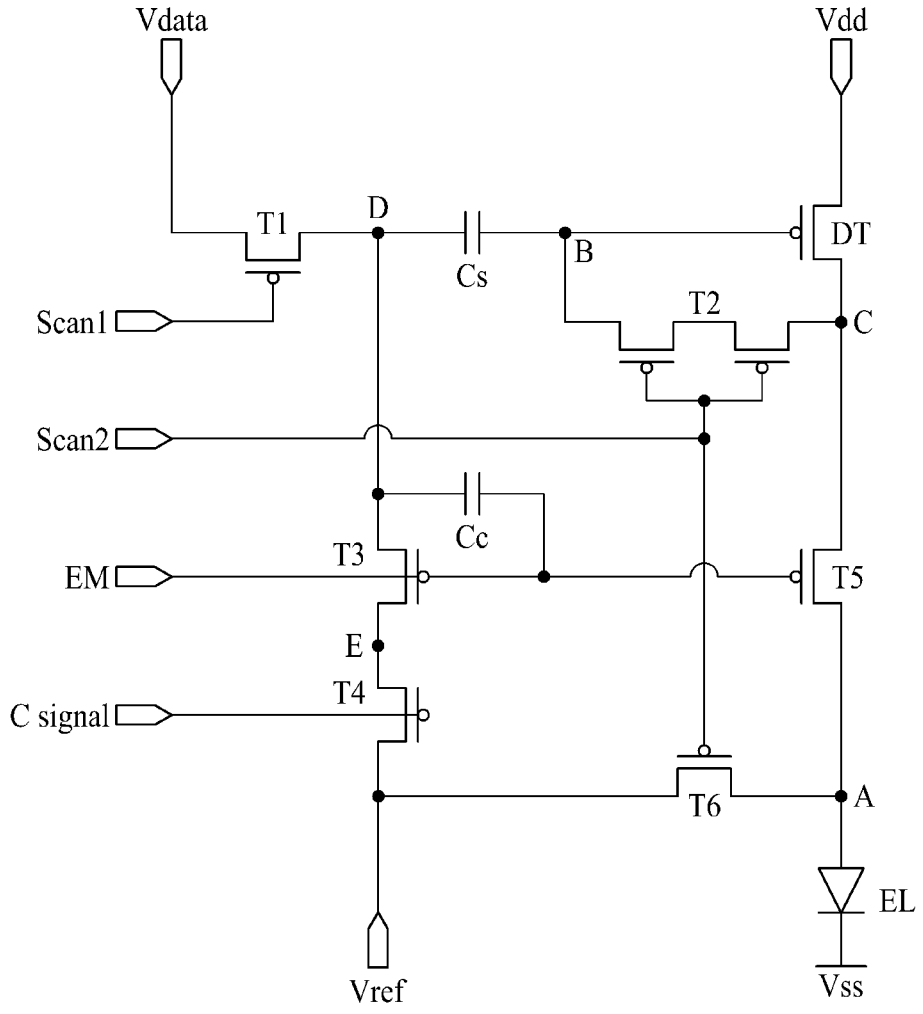
FIG. 3 is a circuit view illustrating a pixel driving circuit and a light emitting diode according to one aspect of the present disclosure.
Figure 4:
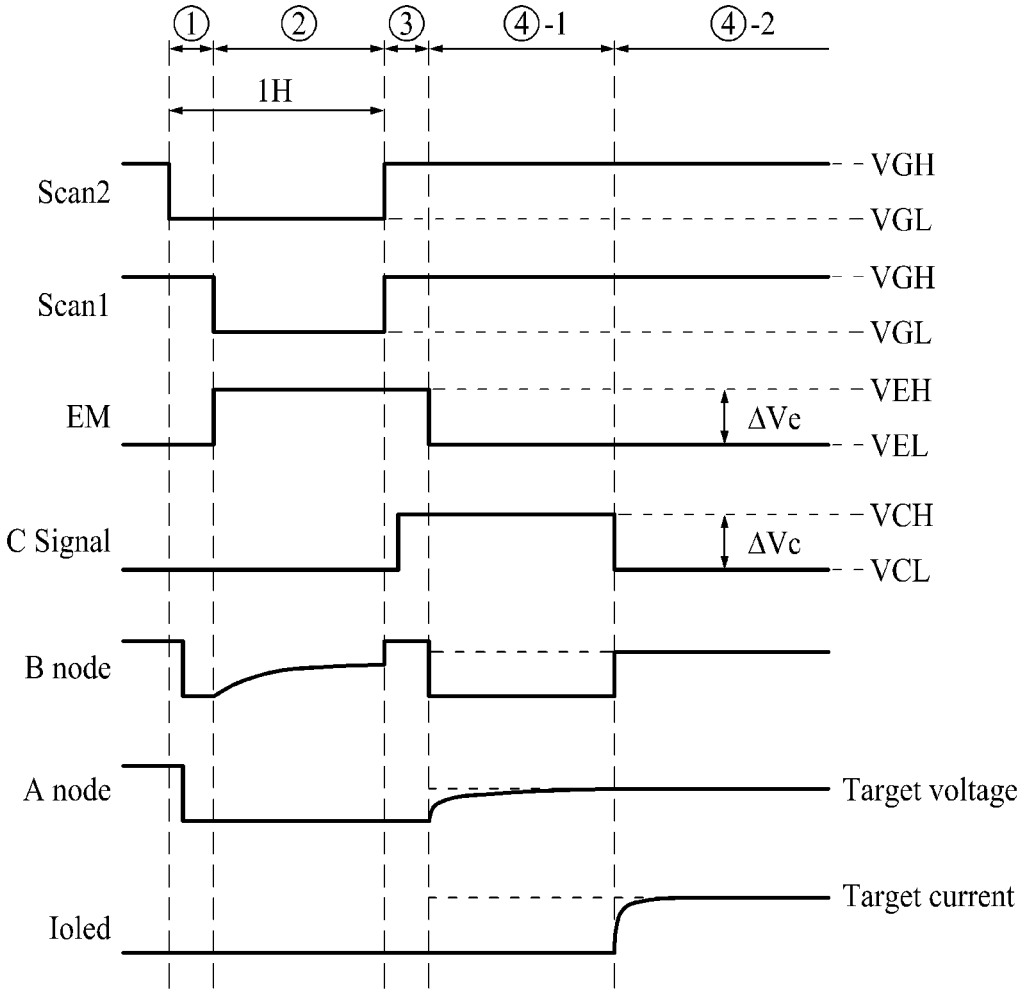
FIG. 4 is a waveform illustrating voltages of specific nodes and gate signals input to a pixel driving circuit according to one aspect of the present disclosure.

FIG. 3 is a circuit view illustrating a pixel driving circuit and a light emitting diode EL according to one aspect of the present disclosure, and FIG. 4 is a waveform illustrating voltages of specific nodes and gate signals entered to the pixel driving circuit according to one aspect of the present disclosure.

As described above, each of the plurality of pixels PX may include a light emitting diode EL and a pixel driving circuit for controlling the amount of a current applied to an anode of the light emitting diode EL.

The anode of the light emitting diode EL may be connected to a node A, and the pixel driving circuit may electronically be connected to the light emitting diode EL in the node A. That is, the pixel driving circuit supplies the driving current to the node A.

Referring to FIGS. 3 and 4, in the pixel driving circuit according to one aspect of the present disclosure, gate signals of a first scan signal Scan1, a second scan signal Scan2, an emission signal EM, and a C signal are supplied through the gate driving circuit GD, a data voltage Vdata is supplied though the data driving circuit 120, and power voltages of a high potential voltage Vdd, a low potential voltage Vss, and a reference voltage Vref are supplied from the voltage generator. In this case, the C signal may be supplied using an emission driving circuit or a scan driving circuit provided in the gate driving circuit GD, or may be supplied to the pixel driving circuit through a C signal generating circuit that is separately provided.

The pixel driving circuit may include a driving transistor DT, a first transistor T1, a second transistor T2, a third transistor T3, a fourth transistor T4, a fifth transistor T5, a storage capacity Cs, and capacity Cc, and may additionally include a sixth transistor T6. The case that the transistors included in the pixel driving circuit according to one aspect of the present disclosure are all P type transistors will be described by way of example. The pixel driving circuit may be driven by being categorized into an initialization period ①, a sampling period ②, a holding period ③, a first emission period ④-1, and a second emission period ④-2.

The first scan signal Scan1 includes a pulse for turning on the first transistor T1 at the sampling period ②. A pulse of the first scan signal Scan1 is a gate low voltage VGL and has a shorter period than a first horizontal period 1H.

Also, the second scan signal Scan2 includes a pulse for turning on the second transistor T2 and the sixth transistor T6 at the initialization period ① and the sampling period ②. A pulse of the second scan signal Scan2 is a gate low voltage VGL and has a pulse of the first horizontal period 1H.

In driving of the pixel driving circuit according to one aspect of the present disclosure, the periods of the pulse of the second scan signal Scan2 are classified into a period for not overlapping the pulse of the first scan signal Scan1 as the initialization period ① and a period where the pulse of the first scan signal Scan1 and the pulse of the second scan signal Scan2 overlap each other as the sampling period ②, but are not limited thereto. For the first scan signal Scan1, it is enough to include a pulse of time to transfer the data voltage Vdata. Therefore, the pulse of the first scan signal Scan1 may be embodied with a shorter time than the sampling period ②.

In order for the pixel driving circuit according to present disclosure to sample and compensate for a threshold voltage of the driving transistor DT as an internal compensation circuit, a more sufficient time should be given to the sampling period ② than the initialization period ①. A reference for classification between the initialization period ① and the sampling period ② is based on an emission signal EM, which will be described below. As a pulse of the emission signal EM starts during the period for overlapping the pulse of the second scan signal Scan2, the initialization period ① ends, and the sampling period ② starts.

The emission signal EM includes a pulse for turning off the third transistor T3 and the fifth transistor T5 during the sampling period ② and the holding period ③. The pulse of the emission signal EM is an emission high voltage VEH and has a pulse of a first horizontal period 1H to a third horizontal period 3H. The pulse of the emission signal EM may be embodied with a width of time that may include the sampling period ②.

Also, the C signal includes a pulse for turning off the fourth transistor T4 during the holding period ③ and the first emission period ④-1. The pulse of the C signal is a C signal high voltage VCH and may be embodied with a width of time that may include the holding period ③.

Hereinafter, driving elements constituting a pixel driving circuit, signals input to the driving elements, and driving of the pixel driving circuit at each of driving periods will be described.

The driving transistor DT is an element for supplying the driving current to the light emitting diode EL, and includes a gate electrode connected to a node B, a source electrode connected to a high potential line to which a high potential voltage Vdd is supplied, and a drain electrode connected to a node C.

During the initialization period ①, since the second scan signal Scan2 and the emission signal EM are in the state of gate-on voltage, the second transistor T2 is turned on by the second scan signal Scan2 and then electronically connects the node B with the node C, and the fifth transistor T5 is turned on by the emission signal EM and then electronically connects the node C with the node A. The third transistor T3 is turned on by the emission signal EM and then electronically connects a node D with a node E, and the fourth transistor T4 is turned on by the C signal and then electronically connects the node E with a line to which a reference voltage is supplied.

The second transistor T2 is connected between the node B and the node C, and is controlled by the second scan signal Scan2 supplied to the second scan line connected to a gate electrode of the second transistor T2. Although the second transistor T2 may be embodied with a single transistor, it may be embodied with a dual gate transistor as shown, whereby a leak current that may occur during the initialization period ① and the sampling period ② may be reduced. The fifth transistor T5 is connected between the node C and the node A and controlled by the emission signal EM supplied to the emission line connected to a gate electrode of the fifth transistor T5. Therefore, the node A, the node C and the node B may maintain the same voltage state during the initialization period ①.

Additionally, a sixth transistor T6 may be provided to allow the node A, the node C and the node B to have specific voltages not random voltages during the initialization period ①. The sixth transistor T6 is connected to the node A and the reference voltage line from which the reference voltage Vref is supplied, and is controlled by the second scan signal Scan2 supplied to the second scan line connected to a gate electrode of the sixth transistor T6. Therefore, the node A, the node C and the node B of the pixel driving circuit may be initialized to the reference voltage Vref during the initialization period ①. That is, the reference voltage Vref is supplied to the anode of the light emitting diode EL during the initialization period ①, and the light emitting diode EL does not emit light because the reference voltage Vref is a voltage lower than a threshold voltage for allowing the light emitting diode EL to emit light.

Also, the pixel driving circuit includes a storage capacitor Cs of which one electrode is connected to the node B and the other electrode is connected to the node D. The storage capacitor Cs is a capacitor of which one electrode is connected to the gate electrode of the driving transistor DT and maintains the turn-on state of the driving transistor DT during the emission period so that the driving transistor DT may generate a certain driving current. The driving transistor DT may initialize capacitance of the storage capacitor Cs to exactly generate the driving current corresponding to a gray scale that needs to be displayed in the pixel PX in which the driving transistor DT is included. Therefore, the pixel driving circuit includes the third transistor T3 and the fourth transistor T4.

The third transistor T3 is connected between the node D and the node E, and is controlled by the emission signal EM supplied to the emission line connected to a gate electrode of the third transistor T3. The fourth transistor T4 is connected between the node E and the reference voltage line, and is controlled by the C signal supplied to the C signal line connected to a gate electrode of the sixth transistor T4. Therefore, since the reference voltage Vref is supplied to the node E and the node D during the initialization period ① and thus the reference voltage Vref is supplied to both of one electrode and the other electrode of the storage capacitor Cs, capacitance of the storage capacitor Cs is initialized to zero.

Also, the pixel driving circuit includes a capacitor Cs of which one electrode is connected to the node D and the other electrode is connected to the emission line. Since the reference voltage Vref is supplied to one electrode of the capacitor Cc and an emission low voltage VEL is supplied to the other electrode during the initialization period ①, the capacitor Cc is charged with the voltages supplied to the one electrode and the other electrode.

During the sampling period ②, the second transistor T2 and the sixth transistor T6 maintain the turn-on state by the second scan signal Scan2, and the first transistor T1 is turned on by the pulse (gate-on voltage) of the first scan signal Scan1 to supply the data voltage Vdata to the node D. The third transistor T3 and the fifth transistor T5 are turned off by the pulse (gate-off voltage) of the emission signal EM. As the third transistor T3 is turned off, when the data voltage Vdata is transferred to the D node by the first transistor T1, the data voltage Vdata does not short from the reference voltage Vref. As the fifth transistor T5 is turned off, the driving transistor DT is diode-connected, and thus a voltage of the gate electrode of the driving transistor DT starts to elevate and then converge on a sum voltage of the high potential voltage Vdd and the threshold voltage Vth of the driving transistor DT.

The first transistor T1 is connected between the node D and the data line DL that supplies the data voltage Vdata, and is controlled by the first scan signal Scan1 supplied to the first scan line connected to the gate electrode of the first transistor T1.

During the sampling period ②, since the node A is maintained at the reference voltage Vref, the light emitting diode EL does not emit light. The sum voltage of the high potential voltage Vdd and the threshold voltage Vth of the driving transistor DT is supplied to the node B that is one electrode of the storage capacitor Cs and the data voltage Vdata is supplied to the node D that is the other electrode of the storage capacitor Cs, whereby capacitance based on the node B and a node voltage is stored in the storage capacitor Cs. Also, the data voltage Vdata is supplied to the node D that is one electrode of the storage capacitor Cc and the emission high voltage VEH is supplied to the other electrode of the capacitor Cc, whereby capacitance based on the voltage supplied to one electrode and the other electrode of the capacitor Cc is stored.

The holding period ③ starts as the first scan signal Scan1 and the second scan signal Scan2 are converted into a gate high voltage VGH. During the holding period ③, the third transistor T3 and the fifth transistor T5 maintain the turn-off state by the pulse of the emission signal EM, the first transistor T1 is turned off by the first scan signal Scan1, and the second transistor T2 and the sixth transistor T6 are turned off by the second scan signal Scan2. The holding period ③ ends as the emission signal EM is converted into an emission low voltage VEL, and has time of several μs prior to emission of light, whereby a buffer time for delay of a rising time of the pulse of the first scan signal Scan1 and the second scan signal Scan2 may be obtained.

During the holding period ③, the voltage of the node B is a little boosted. In this case, as the first scan signal Scan1 and the second scan signal Scan2 are all boosted from a gate low voltage VGL to a gate high voltage VGH, the node B is affected by parasitic capacitance and thus its voltage is a little boosted.

Since the node A maintains the state of the reference voltage Vref even during the holding period ③ although it is electrically floated, the light emitting diode EL does not emit light.

Also, in the holding period ③, the C signal is converted from a C signal low voltage VCL to a C signal high voltage VCH, and the fourth transistor T4 is turned off by the C signal. During the holding period ③, since the first transistor T1 and the third transistor T3 are turned off and the fourth transistor T4 is turned on or off, the node D is electrically floated.

The first emission period ④-1 starts as the emission signal EM is converted from the emission high voltage VEH to the emission low voltage VEL. During the first emission period ④-1, the first transistor T1 is maintained at the turn-off state by the first scan signal Scan1, and the second transistor T2 and the sixth transistor T6 are maintained at the turn-off state by the second scan signal Scan2, and the third transistor T3 and the fifth transistor T5 are turned off by the emission signal EM. The fourth transistor T4 is maintained at the turn-off state by the C signal. Therefore, the node D is electrically floated by the C signal even during the first emission period ④-1 subsequently to the holding period ③.

The first emission period ④-1 may be defined as a period of the pulse of the C signal. The third transistor T3 controlled by the emission signal EM and the fourth transistor T4 controlled by the C signal may be connected with each other in series between the node D and the reference voltage line, and the node D may be maintained at an electrically floated state through the C signal during the first emission period ④-1. In order that the node D is maintained at an electrically floated state during the first emission period ④-1, the third transistor T3 and the fourth transistor T4 are alternately turned doff. To this end, the C signal is converted into the C signal high voltage VCH before the emission signal EM is converted into the emission low voltage VEL, and is converted to the C signal low voltage VCL after the emission signal EM is converted into the emission low voltage VEL. In this case, the third transistor T3 and the fourth transistor T4 may refer to a transistor group for electrically floating the node D during the first emission period ④-1.

One electrode of the capacitor Cc is connected to the node D, its other electrode is connected to the emission line. The emission signal EM is converted into the emission low voltage VEL during the first emission period ④-1, whereby voltage variation occurs in the other electrode of the capacitor Cc, and the node D is affected by a coupling effect of the capacitor Cc. The voltage of the node D is lowered by voltage variation of the emission signal EM, and in this case, a voltage variation value ΔVD of the node D is expressed by the following relation 1.

$$\Delta V_D = (VEH - VEL) \times \frac{CCc + Cpara}{CCs + CCc} \quad \text{[Relation 1]}$$

In this case, CCc is capacitance of the capacitor Cc, CCs is capacitance of the storage capacitor Cs, and Cpara is parasitic capacitance that affects the node D in addition to the storage capacitor Cs and may include capacitance formed in channels of the first transistor T1 and the third transistor T3 and capacitance generated by overlap of lines. A capacitance size of the capacitor Cc is smaller than that of the storage capacitor Cs. Considering a layout of the pixel driving circuit, the capacitance size of the capacitor Cc may be lower than 10% of the capacitance size of the storage capacitor Cs, but is not limited thereto.

The voltage variation of the node D affects the voltage of the node B by the coupling effect of the storage capacitor Cs. The voltage of the node B is lowered by the voltage variation of the node D, and in this case, a voltage variation value ΔVB of the node B is expressed by the following relation 2.

$$\Delta V_B = \Delta V_D \times \frac{CCs}{CCs + Cpara'} \quad \text{[Relation 2]}$$

In this case, Cpara' is parasitic capacitance that affects the node B in addition to the storage capacitor Cs, and may include capacitance formed in channels of the driving transistor DT and the second transistor T2, and capacitance generated by overlap of lines.

During the first emission period ④-1, the node D is electrically floated, and the voltage of the node B is lowered by the capacitor Cc and the storage capacitor Cs. In detail, the voltage of the node B is lowered in accordance with the relation 1 and the relation 2.

The reason why that the first emission period ④-1 is needed is to quickly charge an anode with a target voltage to supply a target current to the light emitting diode EL. In order to supply the driving current to the light emitting diode EL, the driving transistor DT should be turned on. The voltage variation value of the node B turns on the driving transistor DT. A gate-on level of the driving transistor DT may be determined in accordance with swing widths of the storage capacitor Cs, the capacitor Cc and the emission signal EM.

The C signal has a pulse of a C signal high voltage VCH corresponding to a time period more than the holding period ③. In this case, a pulse width of the C signal is the time required to turn on the driving transistor DT by coupling the capacitor Cc and the storage capacitor Cs. A difference between the C signal high voltage VCH and the C signal low voltage VCL may be defined as a swing width ΔVc of the C signal. In short, the pulse width of the C signal is more than the holding period ③, and may be embodied by a pulse having a predetermined swing width ΔVc.

Meanwhile, the swing width ΔVc of the C signal may be determined in accordance with a swing width ΔVe of the emission signal. The emission signal EM is a signal swing between the emission low voltage VEL and the emission high voltage VEH, and the difference between the emission high voltage VEH and the emission low voltage VEL may be defined as the swing width ΔVe of the emission signal EM. The swing width ΔVc of the C signal may be equal to or greater than the swing width ΔVe of the emission signal EM.

As the C signal, a second emission signal that satisfies the aforementioned condition may be used separately, or the emission signal EM may be used. When the second emission signal is used, the gate driving circuit GD may additionally include a C signal generating circuit for supplying the second emission signal. When the emission signal EM is used and the pixel driving circuit to which the C signal is input is disposed at an nth pixel row, the emission signal EM supplied to a (n+1) the pixel row may be used as the C signal.

The capacitor Cc included in the pixel driving circuit according to one aspect of the present disclosure affects the voltage of the node B through the storage capacitor Cs to quickly drop the voltage of the node B, thereby turning on the driving transistor DT. Since the driving current supplied through the driving transistor DT that is turned on quickly charges the anode of the light emitting diode EL, the light emitting diode EL emits light even in case of a low gray scale by using a target current quickly supplied thereto. Therefore, a defect in picture quality of the display panel 110 may be reduced.

During the second emission period ④-2, the C signal is again converted from the C signal low voltage VCL into the C signal high voltage VCH, and the gate voltage of the driving transistor CT is restored to (Vdd+Vth−Vdata−Vref) by a coupling effect of the capacitor Cc. Therefore, the driving transistor DT may supply a driving current Ioled based on the following Equation 1 to the light emitting diode EL.

$$I_{oled} = \frac{k}{2} \times (Vref - Vdata)^2 \quad \text{[Equation 1]}$$

In the Equation 1, k is a constant value for characteristics of the driving transistor DT. Since the driving current Ioled is not affected by the threshold voltage of the driving transistor DT and voltage drop of the high potential voltage Vdd, the light emitting diode EL may emit light at a desired gray scale.

According to the aspects of the present disclosure, the emission period in the pixel driving circuit driven in accordance with the initialization period ①, the sampling period ②, the holding period ③, and the emission period is divided into the first emission period ④-1 and the second emission period ④-2, and the voltage of the gate electrode of the driving transistor DT is dropped by the coupling effect of the capacitor Cc and the storage capacitor Cs to turn on the driving transistor DT during the first emission period ④-1, whereby the anode voltage of the light emitting diode EL may quickly be charged.

The pixel driving circuit and the electroluminescence display device 100 using the same according to the aspect of the present disclosure may be described as follows.

The electroluminescence display device 100 according to one aspect of the present disclosure includes a light emitting diode EL of which anode is connected to a node A, and a pixel driving circuit supplying a driving current Ioled to the node A and including a node B, a node C and a node D. The pixel driving circuit includes a driving transistor DT controlled by a voltage supplied to the node B, a first transistor T1 turned on by a first scan signal Scan1, supplying a data voltage Vdata to the node C, a second transistor T2 turned on by a second scan signal Scan2, electronically connecting the node B with the node C, a third transistor T3 turned on by an emission signal EM, electronically connecting the node D with a node E, a fourth transistor T4 turned on by a C signal, supplying a reference voltage Vref to the node E, a storage capacitor Cs connected to the node B and the node D, and a capacitor Cc connected to the node C and a reference voltage line to which the reference voltage Vref is supplied. In this case, the emission signal EM includes a pulse overlapped with the first scan signal Scan1 and the second scan signal Scan2, and the C signal includes a pulse overlapped with the emission signal EM without being overlapped with the first scan signal Scan1 and the second scan signal Scan2. Therefore, a delay in charging the anode of the light emitting diode EL may be prevented from occurring, and a defect in picture quality of a display panel 110 in case of a low gray scale may be prevented from occurring.

According to another features of the present disclosure, the pixel driving circuit may be driven in accordance with an initialization period ①, a sampling period ②, a holding period ③, a first emission period ④-1 and a second emission period ④-2, and the pulse of the C signal is included in the holding period and the first emission period ④-1. Also, a pulse of the first scan signal Scan1 may be included in the initialization period ① and the sampling period ②, a pulse of the second scan signal Scan2 may be included in the sampling period ②, the pulse of the emission signal may be included in the sampling period ② and the holding period, and the C signal may be overlapped with the emission signal during the holding period ③. Also, a voltage of the node B during the first emission period ④-1 may be lower than that of the node B during the holding period ③ and the second emission period ④-2.

According to another features of the present disclosure, the sampling period ② and the first emission period ④-1 may be periods equal to each other.

According to another features of the present disclosure, a pulse width of the emission signal EM and a pulse width of the C signal may be equal to each other.

According to another features of the present disclosure, the pulse of the C signal may have the same voltage level as that of the emission signal.

According to another features of the present disclosure, the pixel driving circuit may further include a fifth transistor T5 turned on by the emission signal EM, electrically connecting the node A with the node C, and a sixth transistor T6 turned on by the second scan signal Scan2, supplying the reference voltage Vref to the node A.

According to another features of the present disclosure, the capacitor Cc may have capacitance smaller than that of the storage capacitor Cs.

The electroluminescence display 100 device according to one aspect of the present disclosure includes a light emitting diode EL of which anode is connected to a node A, and a pixel driving circuit supplying a driving current Ioled to the node A and including a node B, a node C and a node D. The pixel driving circuit is embodied to be driven in accordance with an initialization period ①, a sampling period ②, a holding period ③, a first emission period ④-1 and a second emission period ④-2, and includes a driving transistor DT controlled by the node B and turned on during the first emission period ④-1 and the second emission period ④-2, a first transistor T1 turned on during the sampling period ②, supplying a data voltage Vdata to the node D, a second transistor T2 turned on during the initialization period ① and the sampling period ②, electronically connecting the node B with the node C, a transistor group T3 and T4 controlled by at least two signals to allow the node D to be maintained at an electrically floated state during the first emission period ④-1, a storage capacitor Cs connected to the node B and the node D, and a capacitor Cc connected to the node D and a gate node of the transistor group T3 and T4. In this case, a voltage of the node B is embodied to be more dropped during the first emission period ④-1 than a voltage of the holding period ③. Therefore, delay in charging the anode of the light emitting diode EL may be prevented from occurring, and a defect in picture quality of a display panel 110 in case of a low gray scale may be prevented from occurring.

According to another features of the present disclosure, the voltage of the node B may be embodied to be more dropped during the first emission period ④-1 than a voltage of the holding period ③.

According to another features of the present disclosure, the voltage of the node B during the first emission period ④-1 may be a voltage based on a coupling effect of the storage capacitor Cs and the capacitor Cc.

According to another features of the present disclosure, the at least two signals controlling the transistor group T3 and T4 may be overlapped with each other during the holding period ③.

According to another features of the present disclosure, the pixel driving circuit may further includes a fifth transistor T5 turned on during the initialization period ①, the first emission period ④-1 and the second emission period ④-2, supplying a reference voltage Vref to the node C, and a sixth transistor T6 turned on during the initialization period ① and the sampling period ②, supplying the reference voltage Vref to the node A. Also, the node A, the node B, the node C and the node D may all be initialized to the reference voltage during the initialization period ①.

According to another features of the present disclosure, the second transistor T2 may be a double gate type transistor.

According to another features of the present disclosure, the transistor group T3 and T4 may be embodied by a plurality of transistors connected in series between the node D and a reference voltage line to which the reference voltage Vref is supplied.

It will be apparent to those skilled in the art that the present disclosure described above is not limited by the above-described aspects and the accompanying drawings and that various substitutions, modifications, and variations can be made in the present disclosure without departing from the scope of the disclosures. Consequently, the scope of the present disclosure is defined by the accompanying claims, and it is intended that all variations or modifications derived from the meaning, scope, and equivalent concept of the claims fall within the scope of the present disclosure.

What is claimed is:

1. An electroluminescence display device comprising:

a light emitting diode having an anode connected to a node A; and a pixel driving circuit supplying a driving current to the node A and including a node B, a node C and a node D, wherein the pixel driving circuit includes:

a driving transistor controlled by a voltage supplied to the node B;

a first transistor turned on by a first scan signal, supplying a data voltage to the node D;

a second transistor turned on by a second scan signal, electronically connecting the node B with the node C;

a third transistor turned on by an emission signal, electronically connecting the node D with a node E;

a fourth transistor turned on by a C signal, supplying a reference voltage to the node E;

a storage capacitor connected to the node B and the node D; and a capacitor connected to the node D and a gate node of the third transistor, wherein the pixel driving circuit is driven in accordance with an initialization period, a sampling period, a holding period, a first emission period and a second emission period, and a pulse of the C signal is included in the holding period and the first emission period, and wherein a pulse of the first scan signal is included in in the sampling period, a pulse of the second scan signal is included in the initialization period and the sampling period, a pulse of the emission signal is included in the sampling period and the holding period, and the C signal overlaps with the emission signal during the holding period.

2. The electroluminescence display device of claim 1, wherein a voltage of the node B during the first emission period is lower than that of the node B during the holding period and the second emission period.

3. The electroluminescence display device of claim 1, wherein a pulse width of the emission signal and a pulse width of the C signal are equal to each other.

4. The electroluminescence display device of claim 1, wherein the pulse of the C signal has a same voltage level as that of the emission signal.

5. The electroluminescence display device of claim 1, wherein the pixel driving circuit further includes a fifth transistor turned on by the emission signal, electrically connecting the node A with the node C, and a sixth transistor turned on by the second scan signal, supplying the reference voltage to the node A.

6. The electroluminescence display device of claim 1, wherein the capacitor has a capacitance smaller than that of the storage capacitor.

7. An electroluminescence display device comprising:

a light emitting diode having an anode connected to a node A; and a pixel driving circuit supplying a driving current to the node A and including a node B, a node C and a node D, wherein the pixel driving circuit is embodied to be driven in accordance with an initialization period, a sampling period, a holding period, a first emission period, and a second emission period, and includes:

a driving transistor controlled by the node B and turned on during the first emission period and the second emission period;

a first transistor turned on during the sampling period, supplying a data voltage to the node D;

a second transistor turned on during the initialization period and the sampling period, electronically connecting the node B with the node C;

a transistor group controlled by at least two signals to allow the node D to be maintained at an electrically floated state during the first emission period;

a storage capacitor connected to the node B and the node D; and a capacitor connected to the node D and a gate node of the transistor group, wherein a voltage of the node B is embodied to be more dropped during the first emission period than a voltage of the holding period.

8. The electroluminescence display device of claim 7, wherein the voltage of the node B during the first emission period is a voltage based on a coupling effect of the storage capacitor and the capacitor.

9. The electroluminescence display device of claim 7, wherein the at least two signals controlling the transistor group overlaps with each other during the holding period.

10. The electroluminescence display device of claim 7, wherein the pixel driving circuit further includes:

a fifth transistor turned on during the initialization period, the first emission period and the second emission period, supplying a reference voltage to the node C; and a sixth transistor turned on during the initialization period and the sampling period, supplying the reference voltage to the node A.

11. The electroluminescence display device of claim 7, wherein the node A, the node B, the node C and the node D are all initialized to the reference voltage during the initialization period.

12. The electroluminescence display device of claim 7, wherein the second transistor includes a double gate type transistor.

13. The electroluminescence display device of claim 7, wherein the transistor group is embodied by a plurality of transistors connected in series between the node D and a reference voltage line to which the reference voltage is supplied.

* * * * *